US009500023B2

(12) United States Patent
Poniros

(10) Patent No.: US 9,500,023 B2
(45) Date of Patent: Nov. 22, 2016

(54) PRE-FABRICATED STRUCTURAL FRAMING KIT AND METHOD

(71) Applicant: John M. Poniros, Mamaroneck, NY (US)

(72) Inventor: John M. Poniros, Mamaroneck, NY (US)

( * ) Notice: Subject to any disclaimer, the term of this patent is extended or adjusted under 35 U.S.C. 154(b) by 39 days.

(21) Appl. No.: 14/635,085

(22) Filed: Mar. 2, 2015

(65) Prior Publication Data

US 2016/0258204 A1 Sep. 8, 2016

(51) Int. Cl.

| | |
|---|---|
| ***E04C 2/38*** | (2006.01) |
| ***E06B 1/04*** | (2006.01) |
| ***E06B 1/36*** | (2006.01) |
| ***E06B 1/52*** | (2006.01) |
| ***E06B 1/56*** | (2006.01) |
| ***E06B 1/60*** | (2006.01) |
| ***E04C 3/02*** | (2006.01) |
| *E06B 3/984* | (2006.01) |
| *E06B 1/08* | (2006.01) |
| *E06B 3/70* | (2006.01) |
| *E04F 21/00* | (2006.01) |
| *E06B 5/04* | (2006.01) |
| *E06B 1/06* | (2006.01) |

(52) U.S. Cl.

CPC . *E06B 1/04* (2013.01); *E04C 3/02* (2013.01); *E06B 1/36* (2013.01); *E06B 1/52* (2013.01); *E06B 1/56* (2013.01); *E06B 1/6015* (2013.01); *E04C 2003/023* (2013.01); *E04F 21/0015* (2013.01); *E04F 21/0023* (2013.01); *E06B 1/06* (2013.01); *E06B 1/08* (2013.01); *E06B 1/526* (2013.01); *E06B 3/984* (2013.01); *E06B 3/9845* (2013.01); *E06B 5/04* (2013.01); *E06B 2003/709* (2013.01); *E06B 2003/7061* (2013.01); *E06B 2003/7088* (2013.01)

(58) Field of Classification Search

CPC .... E06B 1/52; E06B 1/56; E06B 2003/7061; E06B 2003/709; E06B 5/04; E06B 2003/7088; E06B 1/08; E06B 1/06; E06B 3/984; E06B 3/9845; E06B 1/526; E04F 21/0023; E04F 21/0015

USPC ..... 52/745.18, 741.3, 215, 656.5, 204.1, 52/204.2, 210, 211, 212, 656.4, 784.1, 52/456, 656.1, 656.2, 204.7; 49/504, 505

See application file for complete search history.

(56) References Cited

U.S. PATENT DOCUMENTS

| | | | | | |
|---|---|---|---|---|---|
| 3,239,978 | A * | 3/1966 | Parker | E06B 1/6092 | 52/211 |
| 3,336,162 | A * | 8/1967 | Zachmann | H01M 8/182 | 290/40 R |
| 4,862,658 | A * | 9/1989 | Barker | E06B 1/52 | 292/340 |
| 5,365,708 | A * | 11/1994 | Winston | E06B 1/10 | 49/504 |
| 5,603,580 | A | 2/1997 | Leek et al. | | |
| 5,644,870 | A * | 7/1997 | Chen | E06B 3/7001 | 49/501 |

(Continued)

*Primary Examiner* — Chi Q Nguyen

(74) *Attorney, Agent, or Firm* — Schiff Hardin LLP

(57) ABSTRACT

A kit for framing a doorway, window, or passageway in a wall of a building includes a king stud having a channel formed along its length on one side. A jack stud includes a raised strip that is formed along its length, the raised strip fitting into the channel of the king stud to form a beam. A beam is provided on each side of the doorway, window, or passageway. A header extends across the top of the doorway. The header includes end projections that extend into the channels of the king studs and that rest on top of the jack studs of the beams. Brackets may be provided at the bottom of the beam to connect the beam to a bottom plate of a wall frame. A window sill plate extends between and into the king studs for window openings.

15 Claims, 9 Drawing Sheets

(56) References Cited

U.S. PATENT DOCUMENTS 5,974,745 A * 11/1999 Barr ..... E06B 1/10 49/504
6,393,779 B1 * 5/2002 Boldt ..... E06B 1/10 52/204.1
6,729,095 B2 * 5/2004 Wang Chen ..... E06B 3/5892 49/501
8,429,863 B2 4/2013 Poniros
2001/0003889 A1 * 6/2001 Zen ..... E06B 3/822 52/784.1
2010/0287857 A1 * 11/2010 Kerr ..... E06B 3/9845 52/211
2011/0247283 A1 * 10/2011 Pagett ..... E06B 1/06 52/210

* cited by examiner

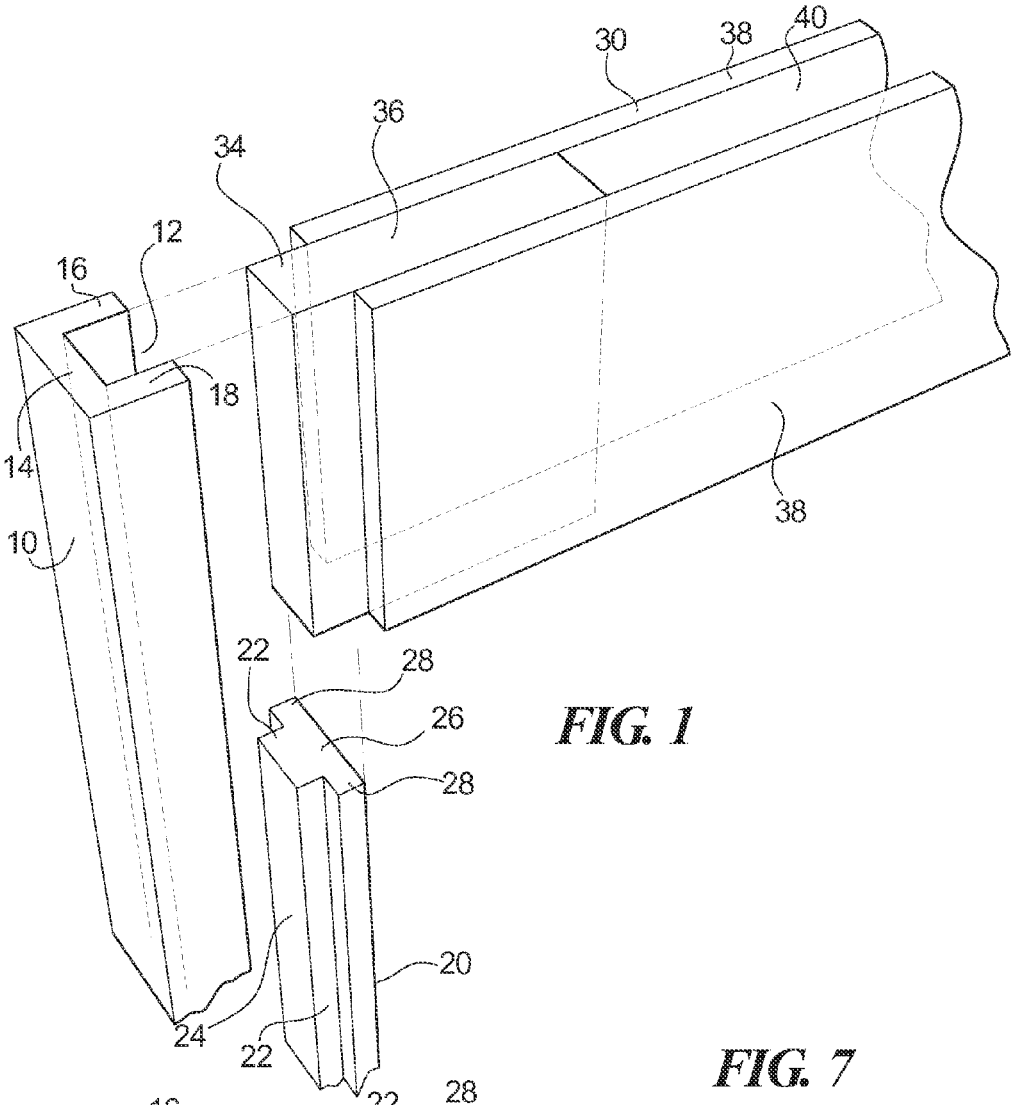
FIG. 1
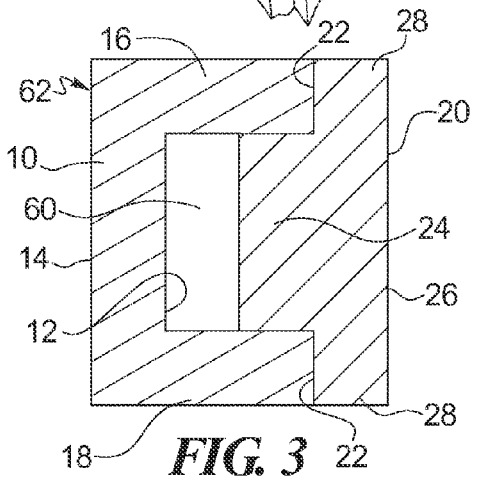
FIG. 3
FIG. 7
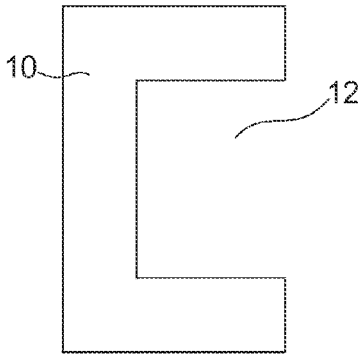

52
36
30
36
42
10
48
50
20
10
50
20
44
58
58
54
46
44
56

PRE-FABRICATED STRUCTURAL FRAMING KIT AND METHOD

BACKGROUND OF THE INVENTION

Field of the Invention

The present invention relates generally to structural elements for a building, and more particularly to a device, method, and system for framing openings in building walls.

Description of the Related Art

Buildings, such as houses and other structures, are commonly constructed of frame-constructed walls that separate the inside of the building from the outside, and that separate rooms from one another, as well as that support a roof and possibly upper floors of the building. The frame-constructed walls are formed by so-called stick members, which include vertical studs, horizontal wall plates, and horizontal load-bearing headers or lintels over portals, doors, windows and fireplaces. The stick members for a stick-built wall may be of wood, steel, or other materials. The frame-constructed walls serve as a base for wall coverings, such as wallboard, siding, wall sheathing, etc.

The walls typically have openings for doors and windows, for example, that are formed in the wall and provided with framing that forms a rough opening for the window or door and that supports the window or door in the wall. In one example, a framed rough window opening has a vertical king stud on each side of the opening extending from the bottom or sole plate of the wall to the top plate of the wall structure. Vertical jack studs are provided below the window opening and vertical cripple studs are provided in the wall above the window opening. Horizontal members of the rough window opening include a sill at the bottom of the window opening and a header or lintel extending horizontally across the top of the opening. Vertical trimmer studs are provided on the sides of the opening extending from the sill to the header or from the sole plate to the header. Doors may be framed in the same way but without the use of a sill and jack studs that form the wall below a window.

Every structural opening of a standard stick-built structure requires at least two king studs, two jack studs, and one header. Typically, these three elements are constructed using solid virgin lumber, the construction of which requires multiple calculations and cuts by the contractor, resulting in pieces of scrap wood and using valuable time. These calculations are based off of the expert knowledge that the professional construction worker has gained. Following this process, the three elements are commonly nailed together to form the opening. In the majority of new construction, walls are framed flat on the floor and then stood up and set in place. With this form of framing, doors and windows are laid out first.

The process of remodeling, although different, also places a major focus on the importance of structural openings. With the top plates and sole plates already installed, studs are cut and installed vertically, to create new openings.

In both cases, the king studs are installed first. The king stud is the piece of lumber that runs from the bottom plate or sole plate of the wall (a horizontal piece of wood usually 1.5 inches thick that acts as the base of the wall to which vertical pieces may be attached) to the top plate of the wall (a horizontal piece that runs parallel to the sole plate that forms the top of the wall). In most states, building codes require that the top plate is to be doubled, making it a total of 3 inches thick. The purpose of the king studs is to uphold the structural integrity of the stud wall and to hold the header in place laterally. King studs can be purchased in pre-cut lengths for standard ceiling heights. For example, for a ceiling height of 8 feet (96 inches), a pre-cut king stud is 92⅝ inches in length. This accounts for a 1.5 inch thick sole plate and a 3 inch top plate. This same calculation is applied to ceilings that are 9 feet and 10 feet high.

Second components of a structural opening are the jack studs (also called trimmers). Jack studs are cut and nailed at the inside surfaces of the king studs relative to the wall opening. The jack studs also rest on the sole plate of the wall. The jack studs are responsible for carrying the header and for distributing the bearing weight that the header carries, down to the base plate, ensuring structural stability. The jack studs are typically cut on the job site, and are measured depending on the door, window, or opening height. For example, for a 6 feet, 8 inch (80 inch) tall door, the jack studs are cut to 80.5 inches and installed on the sole plate. It is common knowledge to construction professionals that in order to fit a 6 feet 8 inch door, the opening in the wall must have a height of roughly 82 inches. The same calculation applies to doors that are 7 feet tall and 8 feet tall. Both jack studs and king studs of a typical building structure are formed of flat pieces of conventional lumber.

The final component of the three components of a structural opening, according to certain embodiments, is the header. The header can be described simply as the structural piece that spans the opening formed by the jack and king studs. The header is placed on top of the jack studs. Whatever weight the header bears is therefore transferred to the jack studs and down to the sole plates. The header is typically placed directly under the top plate, between the two king studs, and bearing on the two jack studs. The amount of weight that the header bears can vary as it is responsible for supporting the weight of the ceiling, as well as any floors above. The load can often determine the height, width, and composition of the header. Headers are normally built using solid conventional lumber. However, headers can also be of engineered materials, sometimes including sandwich structures of steel or plywood depending on the structural strength required. If the only bearing responsibility for the header is to support sheet rock or other wall portion above the header, a hollow header may be used to reduce cost and save material. Headers are easily manipulated and can also be insulated in order to increase the R-value (insulating value) of that area of the building structure. The R-value is the ability of a given space to resist heat flow. A high R-value means less escaping heat or influx of heat when an air conditioner is in use, which can lead to increased savings on energy bills.

The typical necessary dimensions (especially width) of the header are also common knowledge to house construction professionals, for example. The two 1.5 inch jack studs must be accounted for. For a 24 inch wide door, which requires a rough 26 inch wide opening, the header must be cut to 29 inches. When the opening is much larger, it is common for two jack studs to be used on either side of the opening. As a result, the length of the header must account for an added 3 inches on each side, for a total of 6 inches of additional length.

SUMMARY

Certain embodiments of the present invention provide a pre-fabricated framing kit and/or framing elements for structural openings in walls, such as for doors, windows, and the like. In certain embodiments, the window framing components are formed to fit together in interlocking fashion. The framing kit and/or framing elements of certain embodiments includes modified king studs having a C-shaped cross section, modified jack studs that fit together with and extending partially into the C-shaped king studs, and a header that interlocks into the king studs.

Certain embodiments use one or more brackets to secure the framing elements to one another and to other elements of the wall. Certain embodiments include a window sill plate and jack studs below the window sill plate well as jack studs between the window sill plate and the header as a trimmer stud. Certain embodiments include jack studs above the header as cripple studs.

Certain embodiments provide a kit for framing a wall opening, such as a window or door, the kit including brackets to connect the kit components to one another and to wall elements. The brackets may be provided as flat elements that are bent into shape during building of the wall opening. The brackets may instead be provided as formed elements that are pre-bent to shape.

Certain embodiments provide components for locating a wall opening, such as a window or door, adjacent a wall junction.

BRIEF DESCRIPTION OF THE DRAWINGS

FIG. 1 is an enlarged, fragmentary, perspective view of a king stud, jack stud, and header according to certain embodiments of the invention;

FIG. 3 is a cross-sectional view of a king stud and jack stud affixed to one another;

FIG. 7 is an end elevational view of a king stud;

DETAILED DESCRIPTION

Figure 2:
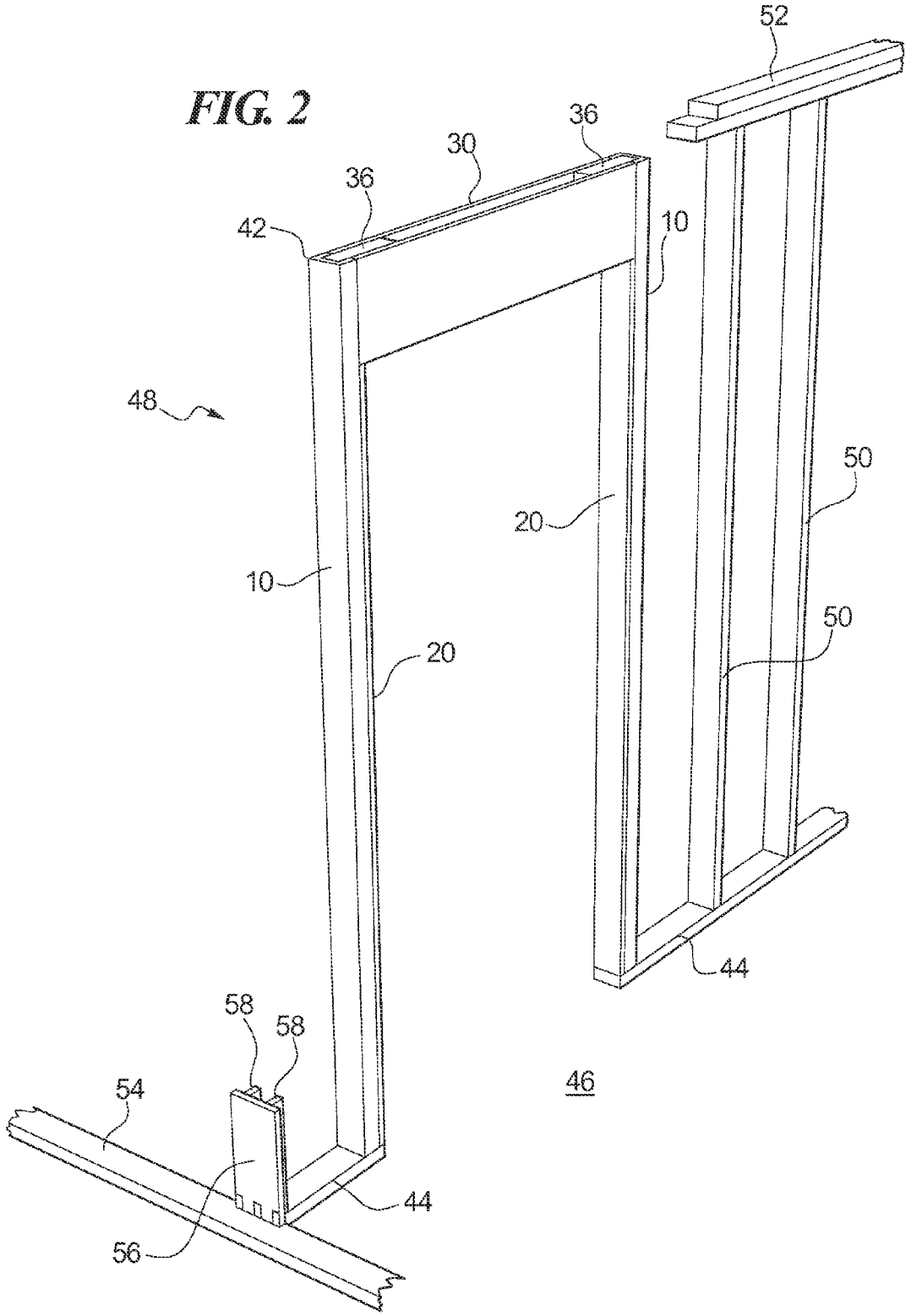
FIG. 2 is a perspective view of a portion of a wall frame including the king stud, jack stud, and header of FIG. 1.

Referring to the figures, in FIG. 1, a kit or system is provided for framing a door or window. The kit includes a king stud 10 as an element of the kit. The king stud 10 is a structural member that has a longitudinal extent of a predetermined length and a generally rectangular cross section. A channel 12 is formed extending into one side of the king stud 10. In certain embodiments, the channel 12 extends along the full length of the king stud 10. Other embodiments are possible in which the channel 12 extends along only a portion of the king stud's length. The channel 12 formed in the king stud 10 results in the king stud 10 having a generally C-shaped cross section with a back portion 14 from which extends two arm portions 16 and 18 on either side of the channel 12.

The king stud 10 may have a generally uniform width and thickness along its length. Embodiments of the king stud are possible that have variations in width and thickness, variations in shape or cross section, or variations in other characteristics. The king stud 10 may be of any length and may have any width and thickness dimension. The king stud 10 is dimensioned to fit in and form a part of a wall of a building, for example. In certain embodiments, the king stud 10 has the dimensions of a standard 2×4 (two by four) building member. Current standard dimensions of a 2×4 building member are nominally 1.74 inches by 3.5 inches. The king stud 10 may be provided in other building member dimensions, including standard 2×3 (two by three) and 2×6 (two by six) building member dimensions, or in any other dimension known in the building trade.

The channel 12 may be of any width and depth. In a certain embodiments, the channel is 1.5 inches deep and has a width of 3.5 inches to 5.5 inches. Other dimensions are of course possible.

A jack stud 20 is provided as a second element of the kit or system. The jack stud 20 is a structural member that has a predetermined length and a generally rectangular shape. The jack stud 20 includes two edge channels 22 formed along opposite edges on one side of the jack stud 20 that extend the length of the jack stud 20. The edge channels 22 form a raised strip 24 that extends the length of the jack stud 20. Embodiments are possible in which the edge channels 22 and/or the raised strip 24 extend along only a portion of the jack stud's length. In certain embodiments, the raised strip 24 is of a width to fit into the channel 12 of the king stud 10. The raised strip 24 may be of a thickness corresponding to the depth of the channel 12, or may be of a thickness less than the depth of the channel 12, or may even be of a thickness greater than the depth of the channel 12.

The jack stud 20 has a back panel 26 on the side opposite the edge channels 22. The back panel 26 of certain embodiments has a width that is approximately the same as the width of the king stud 10. The jack stud 20 may be of a width greater than the king stud 10 or less than the king stud 10 in other embodiments. The back panel 26 forms ears 28 that extend beyond the raised strip 24 along the opposite edges of the jack stud 20.

A header 30 is provided as another element of the kit or system. The header 30 is a structural member that has a predetermined length and is generally rectangular in shape. The header 30 includes an elongated body 32 and an end projection 34. A similar end projection extends from the opposite end of the header 30. The end projection 34 is of a size and shape to fit into the channel 12 of the king stud 10. The end projection 34 may extend from the elongated body 32 by a distance approximately equal to the depth of the channel 12, or may have a length that is greater than or less than the channel depth. The end projection 34 is formed by an end block 36 that is mounted between two header planks 38. The header planks 38 form the elongated body 32. The header planks 38 are spaced from one another by the thickness of the end block 36. A space 40 between the header planks 38 may be either left empty or filled. For example, the space 40 may be filled by a plank, by insulation, or by other structural elements or material.

The king stud 10, jack stud 20, and header 30 may be formed of wood lumber, composite material, manufactured wood, metal such as steel or aluminum, or other building materials. Each may be of the same material or the elements of the kit or system may be of two or more different materials.

The king stud 10, jack stud 20, and header 30 fit together as interlocking parts. The king stud 10, jack stud 20, and header 30 may be fastened to one another by nails, screws, glue and/or other fasteners. The fasteners may be provided where the elements interlock.

Turning to FIG. 2, a king stud 10 is provided on each side of a door frame 42. The king studs 10 are positioned on the outsides of the door frame 42, facing away from each other. A jack stud 20 is provided on each side of the door frame 42; the jack studs 20 being positioned on the insides of the door frame 42 facing toward one another. The header 30 extends across the top of the door frame 42. The header 30 has the two end blocks 36, one at each end, inserted into the king studs 10.

The door frame 42 is provided as part of a wall structure 48 of a building, such as a wall between rooms of the building. The wall structure 48 may instead be an outside wall of the building. At the base of the wall is a bottom plate 44 on which the lower ends of the king stud 10 and jack stud 20 are mounted. The bottom plate 44, also referred to as a sole plate, rests on the floor, indicated generally at 46, of the building. A portion of the bottom plate 44 is cut out at the doorway being framed by the door frame 42. In some walls, the bottom plate 44 extends across the bottom of the door opening.

Wall studs 50 extend from the bottom plate 44 to a top plate 52. The top plate 52 extends along the top of the entire wall, although the top plate is shown cut away for the sake of clarity. The king stud 10 extends from the bottom plate 44 to the top plate 52. Additional wall studs 50 and potentially other framing elements are provided to form the wall frame for the whole wall of the building. The top plate 52 is formed by a double structural member, in the illustrated embodiment. Other constructions for the top plate are of course possible, including single beams or constructed beams. The top plate 52 extends above the door frame 42 and the king studs 10 extend into contact with the underside of the top plate 52, although this is not shown in FIG. 2 to provide a better view of the door frame 42. The present wall structure 48 may also include cripple studs (which are known, but not shown here) extending from the top of the header 30 to the top plate 52. The bottom plate 44 extends to an adjoining wall that includes its own bottom plate 54 on which the adjoining wall is built.

A structural panel 56 is provided on the bottom plate 54 that includes two support strips 58. The structural panel 56 and support strips 58 are the subject of U.S. Pat. No. 8,429,863, which is incorporated herein by reference. The structural panel 56 and support strips 58 are provided at a wall junction of two walls. Although cut off in the drawing to provide a clearer view of the door frame, the structural panel 56 and support strips extend from the base plate to the top plate in certain embodiments. The user may wish to build a door frame, window frame, or doorway adjacent the wall junction. In certain embodiments, the structural panel 56 and support strips 58 take the place of the king stud for the side of the doorway or window closest to the adjoining wall. The support strips 58 are spaced apart by a distance to accommodate the raised strip of the jack stud and the header end or sill plate end. The jack stud is positioned into the gap between the support strips 58 and is fastened in place. The header and/or sill plate are attached to form the doorway or window opening. The side of the opening opposite the support strips 58 and structural panel 56 is formed with the king stud and jack stud as shown herein. The structural panel 56 and support strips may be attached to the base plate 54 by a bracket, as shown in the above-referenced patent.

The illustrated wall structure is but one example of a wall structure in which the door frame 42 may be provided. Other wall structures are also possible and within the scope of this invention. The wall may be completed by providing electrical wiring, plumbing, heating, and other utilities, adding insulation, and finishing the wall with drywall board, plaster, paneling, or other wall materials. Outside walls may include a vapor seal layer, and may be finished using siding, brick, shingles, or other external wall treatment or material.

FIG. 3 is a cross section through the king stud 10 and the jack stud 20. The king stud 10 has the back portion 14 from which extends the arm portions 16 and 18 that define the channel 12. The jack stud 20 has the raised strip 24 extending into the channel 12. The raised strip 24 of the illustrated embodiment has the same width as the channel 12 so that the sides of the raised strip 24 bear against the inside surfaces of the arm portions 16 and 18 of the king stud 10. The back panel 26 of the jack stud 20 is of the same width as the king stud 10 in the illustrated embodiment. The ears 28 of the jack stud 20 are mounted on the free ends of the arm portions 16 and 18. Said another way, the edge channels 22 formed into the jack stud 20 are configured to accept the arm portions 16 and 18 of the king stud 10.

The depth of the channel 12 is greater than the height of the raised strip 24 in the illustrated embodiment. The dimensions result in an interior space 60 within a beam 62 formed by the joined king stud 10 and jack stud 20. The beam 62 may be formed to have a greater or lesser interior space. For example, the raised strip 24 of the jack stud 20 may completely fill the channel 12 so that no interior space is provided within the beam 62. Or only a small interior space 60 may be provided, or a large interior space may be provided.

The king stud 10 and jack stud 20 may be fastened together, such as by nails, screws, glue, rivets, or other fasteners or fastening means. Any fastener to affix the king stud 10 and jack stud 20 to one another may be used.

Figure 4:
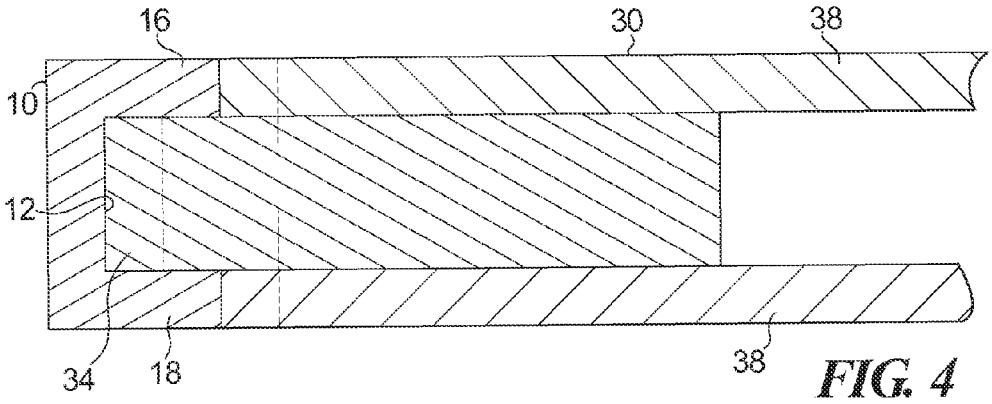
FIG. 4 is a cross-sectional view of a king stud and a portion of a header affixed to one another.

Referring to FIG. 4, a cross section is shown through the king stud 10 and the header 30. The end projection 34 of the header 30 is configured to completely fill the channel 12 in the king stud 10. The end projection 34 is of approximately the same width as the channel 12 so that the sides of the end projection 34 bear against the inside surfaces of the arm portions 16 and 18. The end projection 34 extends beyond the header planks 38 by a distance that is approximately the same as the depth of the channel 12 in the king stud 10. Said another way, the arm portions 16 and 18 are of a length that approximately matches the length of the end projection 34. The header planks 38 are of a thickness that is approximately the same as the thickness of the arm portions 16 and 18 in the illustrated embodiment.

The dimensions of the illustrated embodiment result in, a king stud 10 and jack stud 20 and header 30 that are all of the same thickness within the wall and have even outside surfaces. It becomes easier to form the wall of wall board, paneling, or other materials without irregularities in the wall surface or the requirement to shim wall panels or add large quantities of drywall compound to achieve a smooth and even wall.

The king stud 10 and header 30 are fastened to one another by nails, screws, glue, rivets, or other fasteners or fastening means. Any fastener to affix the king stud 10 and the header 30 to one another may be used.

Figure 5:
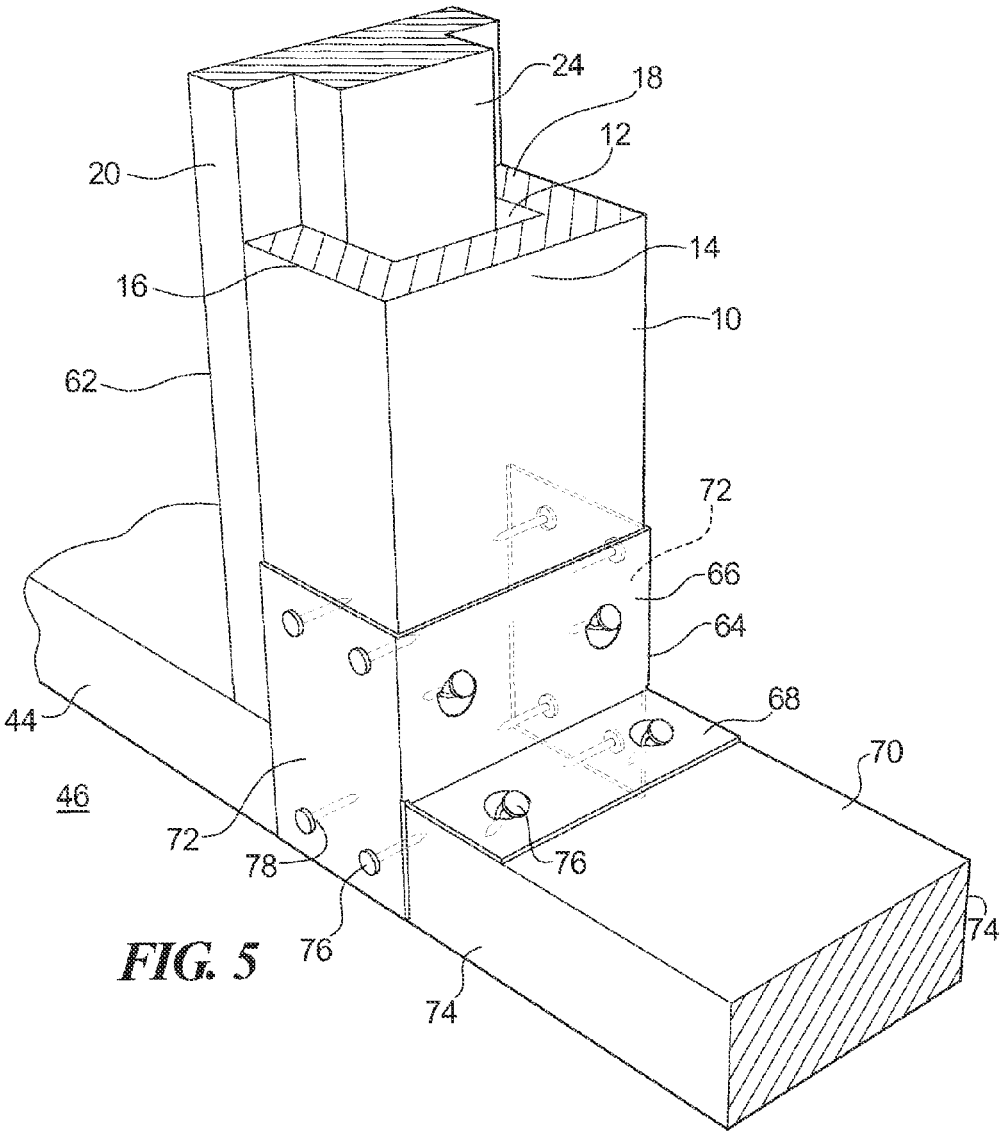
FIG. 5 is an enlarged perspective view of a joined king stud and jack stud connected to a bottom plate.

Turning now to FIG. 5, a bottom plate 44 is provided at the floor 46 of the house or other building. The king stud 10 is mounted to bear against the bottom plate 44 by its end resting on the bottom plate 44. The jack stud 20 is positioned with its raised strip 24 extending into the channel 12 of the king stud 10 and with its lower end resting on and bearing against the bottom plate 44. The jack stud 20 and king stud 10 are fastened together to form the beam 62. The beam 62 may be attached to the bottom plate 44 using nails or screws, for example. In the illustrated embodiment, a bracket 64 is provided that attaches the king stud 10 to the bottom plate 44. The bracket 64 has a first portion 66 in contact with the back portion 14 of the king stud 10, a second portion 68 in contact with a top surface 70 of the bottom plate 44, and side portions 72 that are in contact with the arm portions 16 and 18 of the king stud 10 and the sides 74 of the bottom plate 44.

The bracket 64 is fastened to the king stud 10 and the bottom plate 44 by nails 76 in the illustrated embodiment. The bracket 64 includes circular nail openings 78 in the side portions 74 for receiving nails 76 inserted at generally right angles to the bracket 64. The bracket 64 includes angled nail receiving openings 80 for receiving nails 76 at an angle to the bracket 64. The angled nail receiving openings 80 are partial cup-shaped projections extending from the surface of the bracket 64 to receive a nail 76 at, for example, an approximately 45 degree angle to the surface of the bracket 64. The projections form guideways for the nails or other fasteners.

Figure 6A:
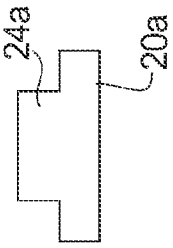
FIGS. 6*a*, 6*b*, 6*c*, 6*d*, 6*e*, 6*f*, 6*g*, 6*h*, 6*i* and 6*j* are end elevational views of various embodiments of jack studs.
Figure 6B:
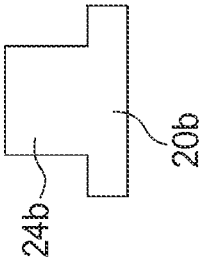
Figure 6C:
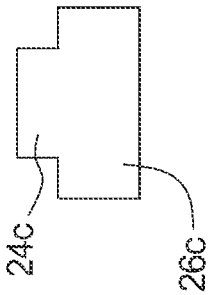
Figure 6D:
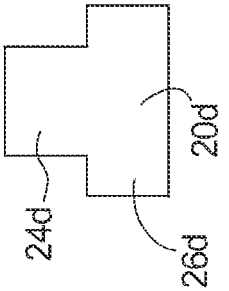
Figure 6E:
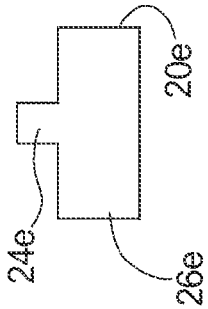
Figure 6F:
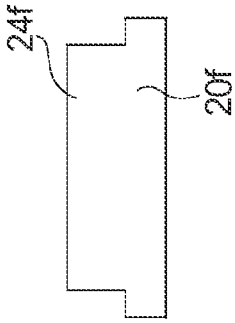

FIGS. 6*a*, 6*b*, 6*c*, 6*d*, 6*e*, 6*f*, 6*g*, 6*h*, 6*i* and 6*j* show various embodiments of the jack stud 20. For example, the jack stud 20*a* of FIG. 6*a* is configured to fit a king stud 10 having the overall shape and size of a 2×4 structural member while leaving the interior space 60 open. The jack stud 20*f* of FIG. 6*f* is configured to fit a king stud 10 having the overall shape and size of a 2×6 structural member, while leaving the interior space 60 open. In particular, the jack stud 20*a* has a width of approximately 3.5 inches and the jack stud 20*f* has a width of approximately 5.5 inches.

Figure 6G:
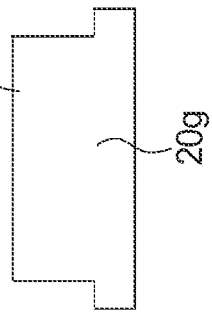
Figure 6H:
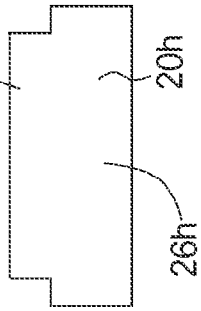

The jack stud 20*b* of FIG. 6*b* is configured to fit a king stud having an overall shape of a 2×4 structural member. The raised strip 24*b* extends to a height to fill or nearly fill the channel 12 of the king stud 10 and thereby fill the interior space 60 of the beam 62. FIG. 6*g* is a jack stud 20*g* that is of a size and shape to fit a 2×6 king stud 10 and has a raised strip 24*g* to fill or nearly fill the channel 12. In FIG. 6*c*, a jack stud 20*c* is configured with a thicker back panel 26*c*. The raised strip 24*c* may be configured to leave the interior space 60 in a 2×4 king stud. A jack stud 20*h* for a 2×6 king stud also includes a thicker back panel 26*h* in FIG. 6*h*. The thicker back panels may provide greater strength where needed, for example.

Figure 6I:
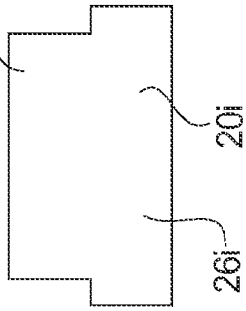
Figure 6J:
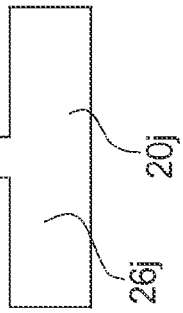

FIG. 6*d* includes both the higher raised strip 24*d* and the thicker back panel 26*d* in a jack stud 20*d* for a 2×4 king stud. The jack stud 20*i* includes the thicker back panel 26*i* and higher raised strip 24*i* in a configuration for a 2×6 king stud, as shown in FIG. 6*i*. Each of the illustrated jack studs of FIGS. 6*a*-6*d* and 6*f*-6*i* are configured with a relatively wide raised strip 24 for fitting into a relatively wide channel 12. The scope of the present invention provides that the raised strip 24 may be provided in other dimensions as well. For example, a jack stud 20*e* is shown in FIG. 6*e* with a narrow raised strip 24*e*. The narrow raised strip 24*e* may fit into a correspondingly narrow channel 12 in the king stud 10. It is also possible that the narrow raised strip 24*e* may fit into a wide channel 12, leaving gaps between the sides of the raised strip and the sides of the channel. The jack stud 20*e* has a thicker back panel 26*e*, although a thinner back panel is also possible. The jack stud 20*e* is configured to fit a 2×4 king stud, whereas the jack stud 20*j* of FIG. 6*j* is configured to fit a 2×6 king stud. The jack stud 20*j* has a narrow raised strip 24*j* to fit into a narrow channel 12. Other configurations and shapes of jack studs are possible within the scope of the present invention.

In FIG. 7 is an end view of the king stud 10. The king stud 10 may be in the shape of a 2×4 building element or may be proportioned in the shape of a 2×6 building element or any other shape or size. The channel 12 in the king stud 10 is relatively wide to receive a relatively wide raised strip from the jack stud 20. It is possible that the channel 12 may be wider or narrower, shallower or deeper. The king stud 10 may be shaped with a narrow channel to fit a relatively narrow raised strip of a jack stud, for example as shown in FIG. 6*e* or 6*j*. The channel 12 may have the depth illustrated or may be shallower or deeper, for example, to accommodate raised strips that are of different heights. Other variations in dimensions and proportions are possible. The various sizes and shapes of the king stud 10 are provided to fit the various jack studs shown in FIGS. 6*a*-6*j*, for example. The changes relate primarily to the channel width and depth. Corresponding variations in the end sizes and shapes of the header and sill elements to fit the king stud and jack stud are provided as well. The variations in the sizes and shapes of the differently proportioned element will be apparent to those skilled in the art. The variations of the elements, although not shown for the sake of avoiding undue repetition, are within the scope of the invention.

Figures 8A, 8B, 8C:
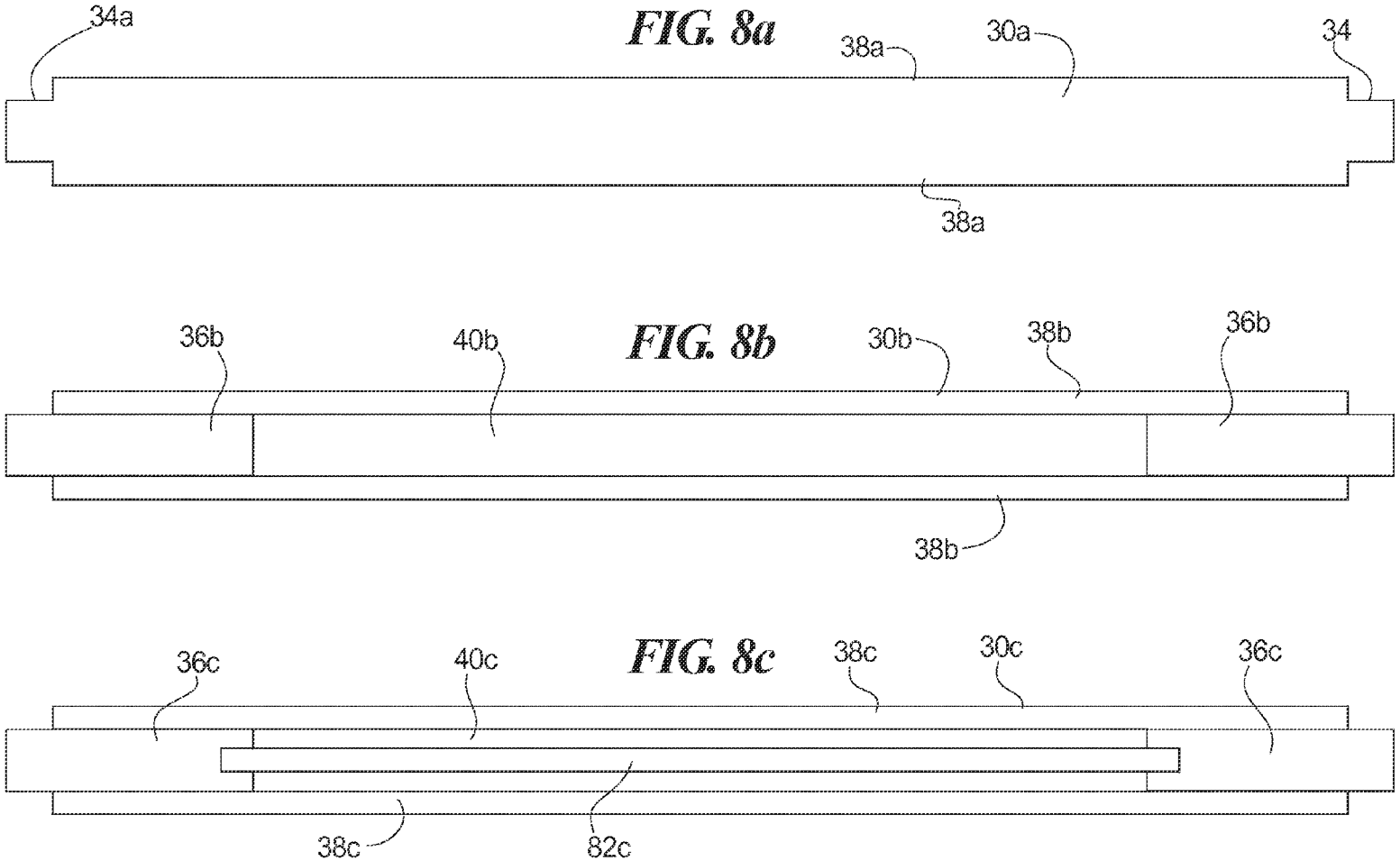
FIGS. 8*a*, 8*b*, and 8*c* are side elevational views of various embodiments of headers.

FIG. 8*a* shows an embodiment of a header 30*a* that is formed of a solid piece of material. The header 30*a* may also be formed from various separate pieces that are joined to form the solid header 30*a*. The header 30*a* includes end projections 34*a* that fit into the channels 12 of the king studs 10. The header 30*a* is shaped to provide header planks 38*a* as part of the solid body of the header 30*a*.

The header 30*b* of FIG. 8*b* is constructed similar to that shown in FIG. 1, including end blocks 36*b* at each end of the header 30*b*. The end blocks 36*b* are connected to one another by the header planks 38. The space 40*b* between the header planks 38 may be left empty, may be filled with insulation, or may be filled or partially filled with any material.

With reference to FIG. 8*c*, a header 30*c* has the header planks 38*c* connecting the end blocks 36*c* to one another. Within the space 40*c* between the planks 38*c* is provided a third plank 82*c*. The third plank 82*c* fits into recesses formed into the end blocks 36*c* and is disposed approximately midway between the planks 38*c*. The space 40*c* is divided into two parts, which may be left empty or provided with insulation or other materials.

Figure 9:
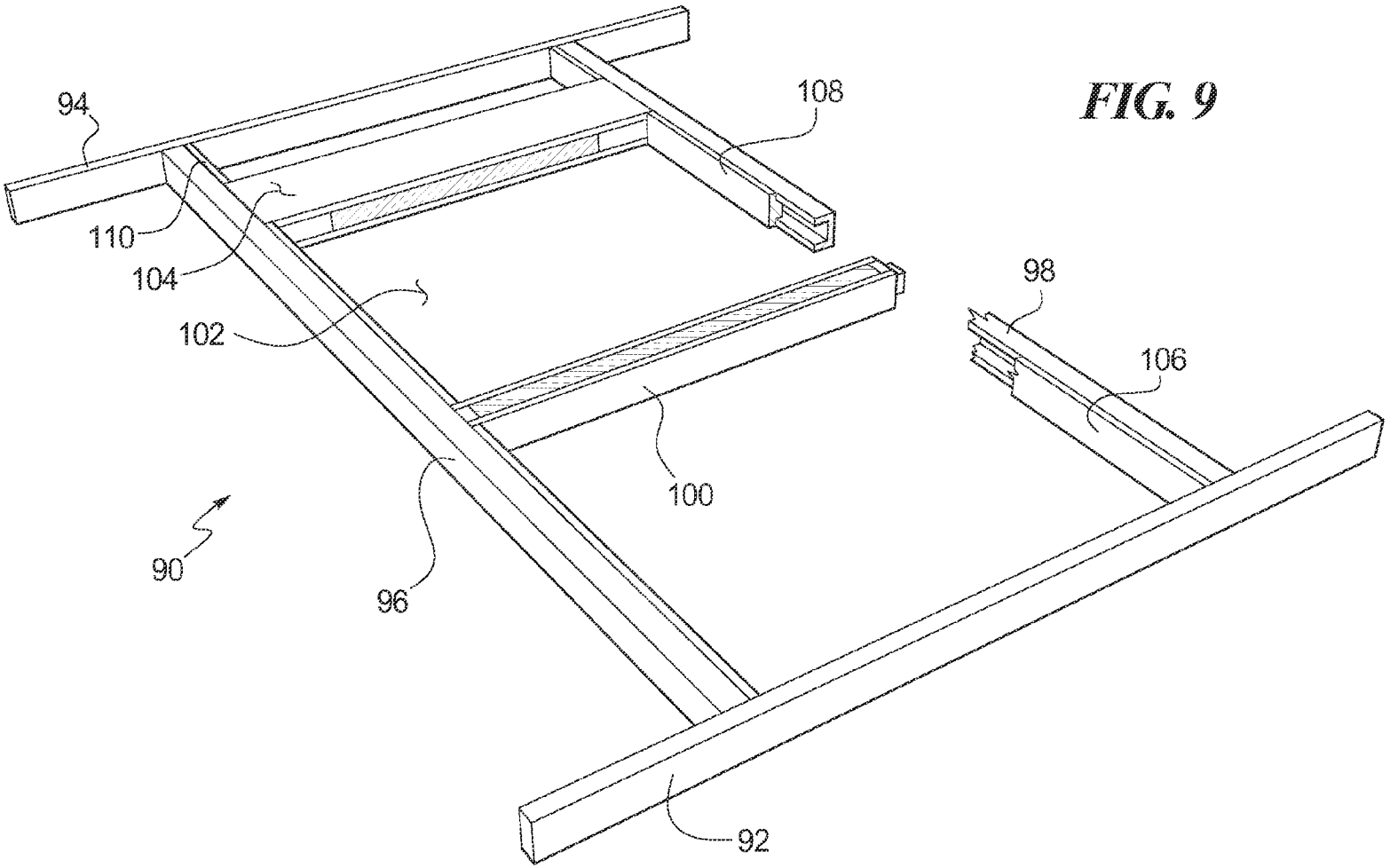
FIG. 9 is a perspective view of a portion of a wall frame in which a window opening is formed.

In FIG. 9, a wall frame portion 90 is shown lying down as it would be assembled prior to being lifted into place as a wall of a building. The wall frame portion 90 includes a bottom plate 92 and a top plate 94. Between the bottom plate 92 and top plate 94 extends king studs 96 and 98. A window opening is formed by a window sill plate 100 that extends between the king studs 96 and 98 below the window opening 102 and a header 104 that extends between the king studs 96 and 98 above the window opening 102. First jack studs 106 are located below the window sill plate 100, extending between the bottom plate 92 and the window sill plate 100. The first jack studs 106 are disposed on the insides of the framed window, facing the window opening just like the jack studs that form a doorway or door opening. The first jack studs 106 include raised strips extending into channels on the king studs 96 and 98, similar to those shown herein.

Between the sill plate 100 and the header 104 are provided second jack studs 108. The second jack studs 108 include raised strips that extend into channels on the king studs 96 and 98, like other jack studs shown herein. The second jack studs 108 face toward one another at the window opening 102. Said another way, the second jack studs 108 face the window opening 102. The second jack studs 108 may be referred to as trimmer studs.

Above the header 104 may be provided third jack studs 110 that extend from the header 104 to the top plate 94. The third jack studs 110 may be referred to as cripple studs. The third jack studs 110 may have raised strips that extend into channels on the king studs 96 and 98. Similar jack studs as cripple studs may be provided on embodiments forming a door opening or doorway.

The window sill plate 100 and the header 104 shown in FIG. 9 are both insulated. Non-insulated versions may be provided as desired. The insulated sill plate 100 and header 104 are provided with insulating material in openings within the respective building element. The king stud 98 and the jack studs 106 and 108 are shown broken away to reveal the structural features. In practice, the king studs 96 and 98 are one piece members extending from the bottom plate 92 to the top plate 94 and the jack studs 106 and 108 extend into contact with the sill plate 100.

Figure 10:
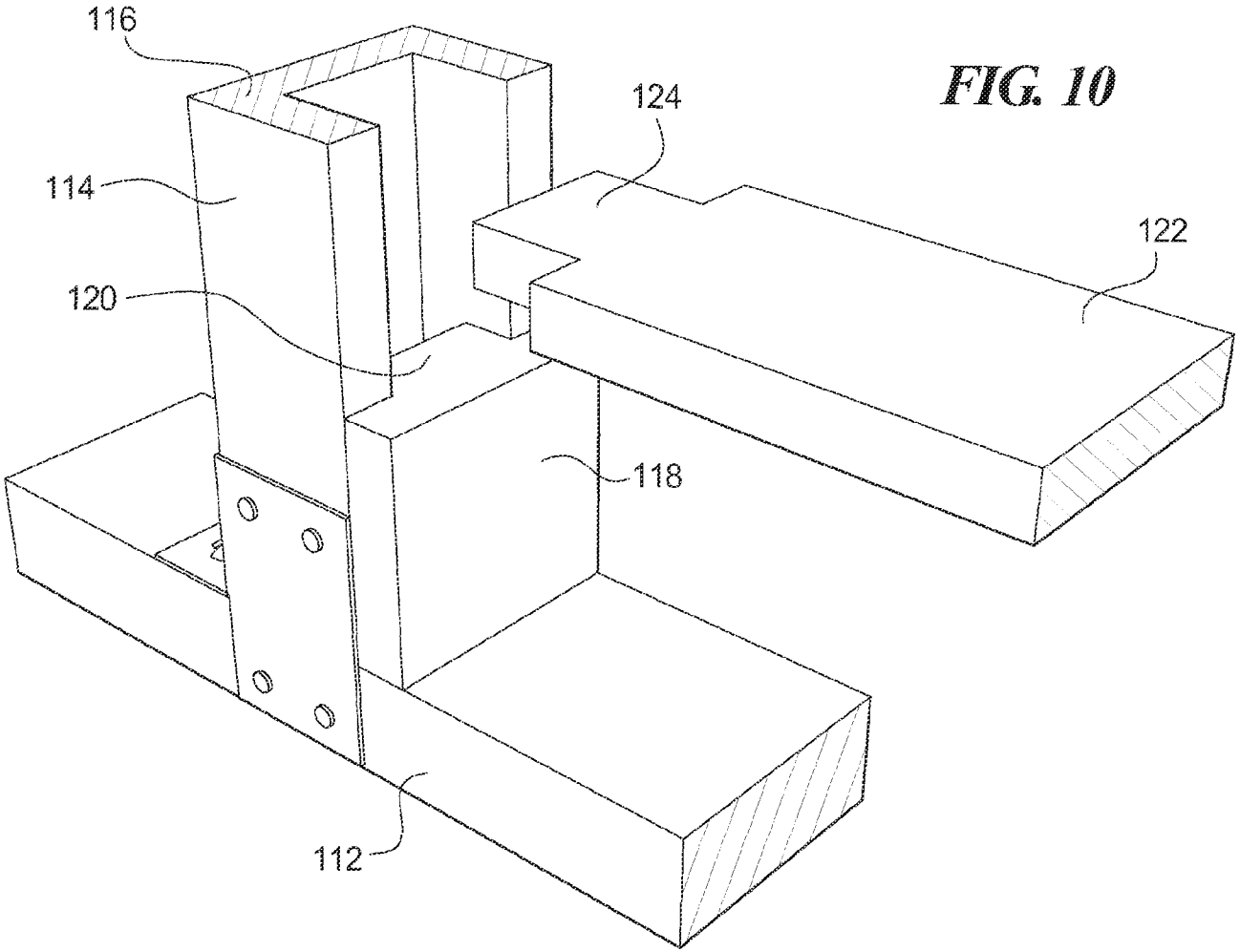
FIG. 10 is an enlarged fragmentary view of a window sill being inserted into a king stud.

FIG. 10 is a fragmentary view of a bottom plate 112 or base plate on which is mounted a king stud 114 that has a channel 116. A jack stud 118 has a raised strip 120 that fits into the channel 116. The jack stud 114 can be of any length to define the height of the sill plate from the bottom plate 112. A window sill plate 122 is provided with an end projection 124 that is configured to fit into the channel 116 of the king stud 114. The window sill plate 122 rests on the jack stud 118 for support. The other end of the window sill plate 122 is provided with a similar shape and is mounted in the king stud on the other side of the window opening. A second jack stud or trimmer stud is mounted in the king stud 114 above the sill plate 122. A bracket 126 connects the king stud 114 to the bottom plate 112. The bracket 126 may be configured as shown in the examples shown herein.

Figure 11:
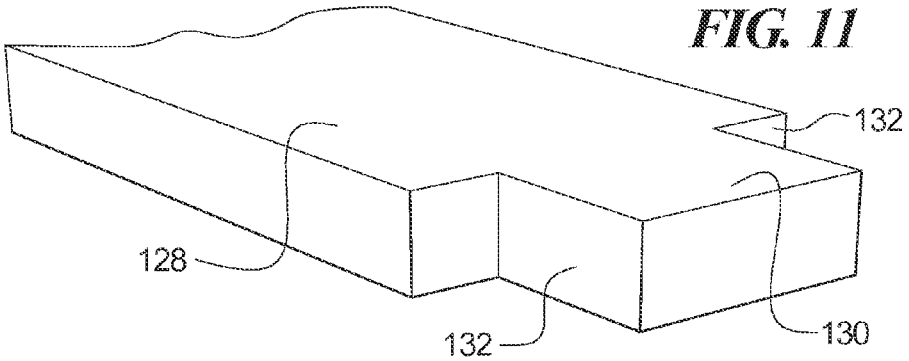
FIG. 11 is a perspective view of a portion of a window sill plate.
Figure 12:
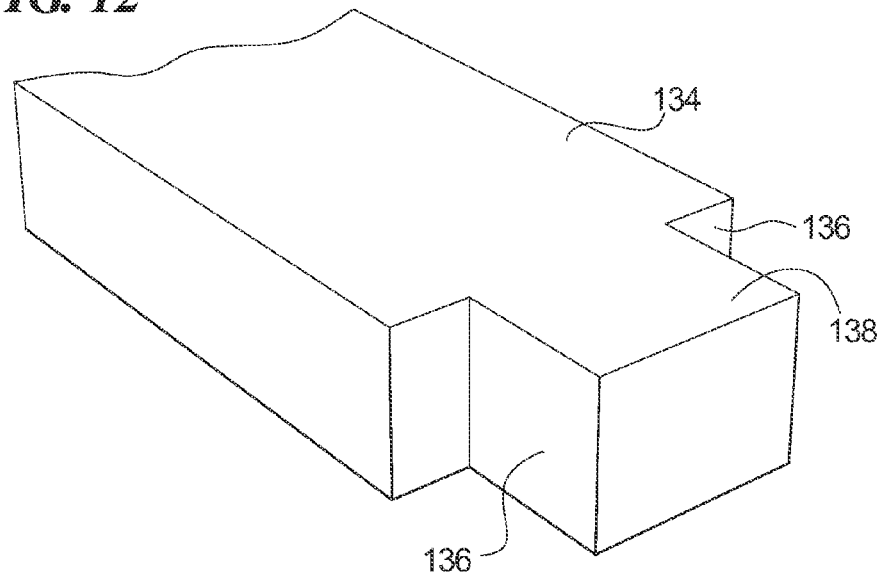
FIG. 12 is a perspective view of a portion of a double window sill plate.

FIG. 11 shows a window sill plate 128 of a single thickness. The single thickness may be a single thickness of lumber, plywood, chip board or other building materials. The sill plate 128 has a shaped end 130 configured with two corner cut outs 132 that enable the end 130 to fit into the king stud. In FIG. 12 is shown a double sill plate 134. The double sill plate 134 may be of material that has a greater thickness than a single sill plate or may be formed of two or more thinner sill plates. The double sill plate 134 has corner cut outs 136 that shape the end 138 to fit into a king stud. The double sill plate 134 may be used for larger windows, heavier windows, or anywhere desired.

Figure 13:
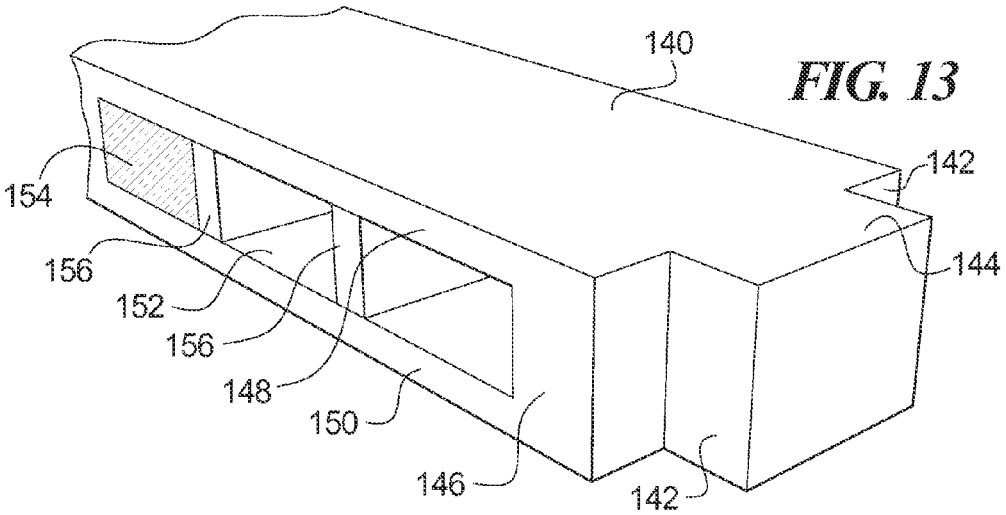
FIG. 13 is a perspective view of a portion of an insulated window sill plate.

FIG. 13 is an example of a hollow window sill plate 140 that has corner cut outs 142 that shape the end 144 to fit into a king stud. The end 144 is connected to a solid portion 146 from which extend a top sill member 148 and a bottom sill member 150. The top sill member 148 and bottom sill member 150 are spaced apart to provide a space 152 therebetween. The space 152 may be provided with an insulating material 154, shown schematically in this illustration. The insulating material 154 may be of any insulating material desired. Supports 156 may be provided extending between the top sill member 148 and the bottom sill member 150 for added strength. The supports 156 divide the space 152 into sub-spaces, which may be individually provided with insulation or other material, or may be left empty.

Figure 14:
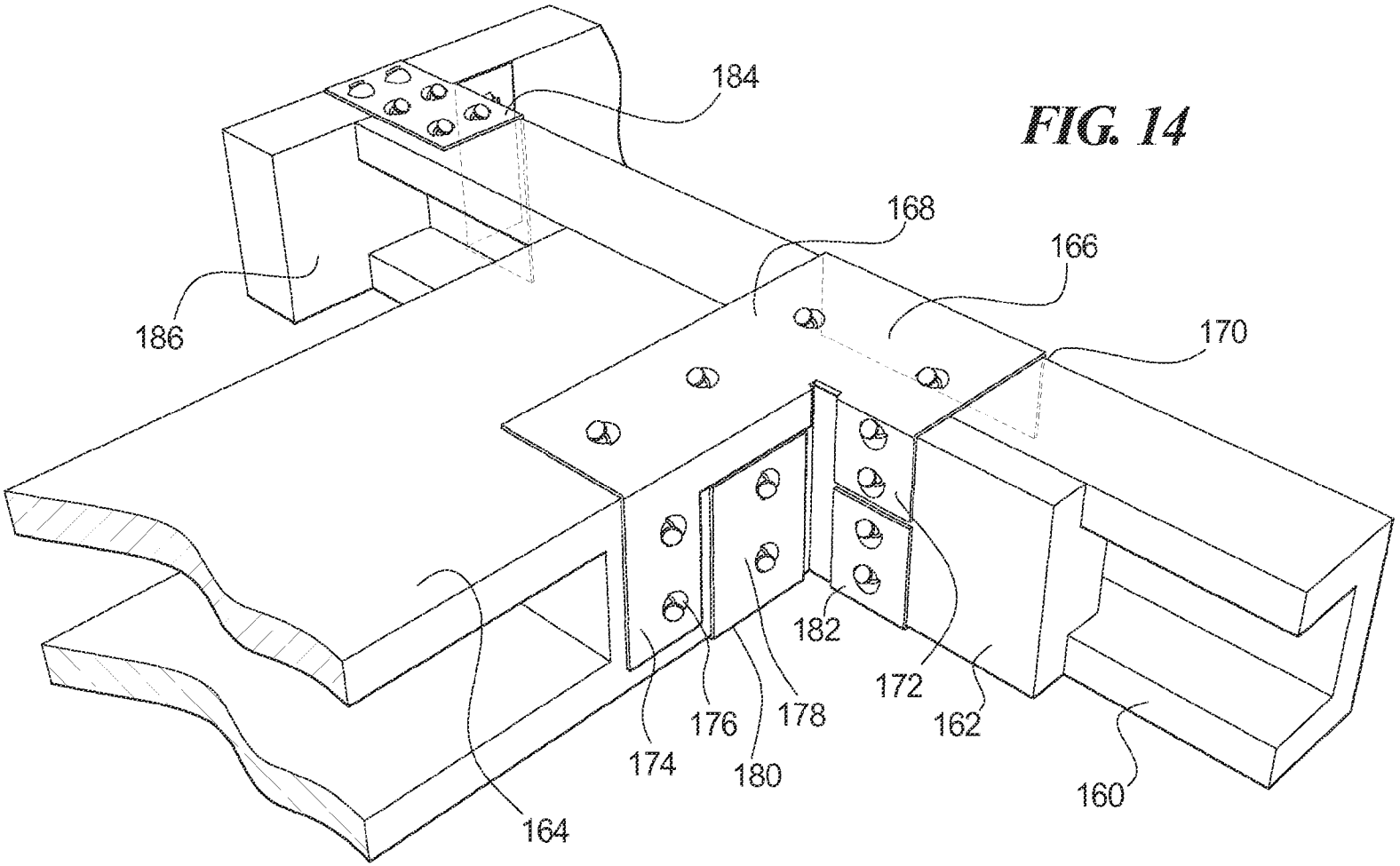
FIG. 14 is a perspective view of a portion of a header and top plate connected to a king stud.

Turning to FIG. 14, a king stud 160 is provided in mated connection with a jack stud 162. The jack stud 162 may extend from the bottom plate or from a sill plate. The jack stud 162 supports a header 164. The king stud 160, jack stud 162, and header 164 are all connected to each other by a bracket 166. The bracket 166 has a first L-shaped portion 168 disposed on the king stud 160 and the header 164. A first flange 170 is bent to engage the back surface of the king stud 160. A second flange 172 is bent to engage the back surface of the jack stud 162. A third flange 174 is bent to engage the bottom of the header 164. Each of the portions and flanges may be provided with openings 176 for receiving nails or other fasteners.

The bracket 166 is shown on what may be referred to as the front of the frame. A bracket 180 may also be provided on the back of the frame. The bracket 180 on the back of the frame may be of the same shape or of a similar shape as the bracket 166. It is possible that the front side bracket 166 and back side bracket 180 have different shapes. In one example, the second flange 172 of the front side bracket 166 extends less than half way across the jack stud 162. The back side bracket 180 has a similar flange 182 that extends on the jack stud 162. The flanges 172 and 182 are of lengths so as not to contact or interfere with one another. All flanges on the brackets may be formed to extend less than have the distance of the member on which they are bent to avoid interference with flanges on the opposing side.

The bracket 166 has the third flange 174 on the header 164 extending greater than half way across the surface of the header 164. To avoid interference or overlap with flanges on the bracket 180 on the back side of the frame, the third flange 174 is offset away from the king stud 160 to leave a gap between the flange 174 and the jack stud 162. The back side bracket 180 has a flange 178 that is offset toward the king stud 160 to fit into the gap left by the front side flange 166. The offset positions of the two flanges 174 and 178 avoid interference between the flanges, permitting both the front side bracket and the back side bracket to be attached at the junction of the parts.

Multiple brackets may be provided in certain embodiments. The brackets may have shortened flanges, for example like flanges 172 and 182, or offset flanges, for example like flanges 174 and 178, or the brackets may have both types as in the illustrated example. The brackets may be of a mirror image shapes for connection opposite sides of the king stud/jack stud/header joint. Other bracket shapes are possible and within the scope of the invention.

A top plate bracket 184 is provided between the top plate 186 and the king stud 160. The top plate bracket 184 may be configured like the bracket for connecting the king stud to the bottom plate. Other shapes and configurations of brackets are also possible.

In certain embodiments, the brackets are provided to the user as generally flat sheet material that has been cut to shape and provided with nail holes and nailways. The user may bend the flanges of the flat brackets into shape while assembling the frame elements. The flat brackets facilitate packing and shipping, and may be bent to accommodate variations in the dimensions of the joint to which the bracket is attached. The brackets may be scored, cut, formed or otherwise provided with features that facilitate bending along the desired bend locations. It is also possible that the brackets are provided in a preformed, pre-bent condition so they are ready to mount to the joint. The same is true for all brackets used in constructing the frame.

The frame kit for a door or doorway includes a single header, two king studs and two jack studs, and possibly brackets, fasteners, instructions, and/or other materials. The frame kit as shown in FIG. 2 is provided for a doorway in a wall. The doorway may have a door mounted therein or may be left without a door. The frame kit may be provided for mounting a window in a wall or for forming a window opening. For example, the kit may include a header, two king studs of a length to extend from the header to the bottom plate, a sill plate, two jack studs to extend from the sill plate to the bottom plate, and two trimmer studs to fit between the header and the sill plate. The jack studs are shaped like those shown herein but are shorter and the trimmer studs are shaped like the jack studs but of a length to fit the sides of the rough window opening. The person of ordinary skill in this art will understand that the window framing kit can include the same elements as shown herein but of shorter lengths as needed.

Other wall openings may be provided using the present elements and/or kit as well, including wall openings, skylights, passageways, hallway entrances, or other structural features.

There is shown and described herein a device, system, and method for framing doors, windows, and passageways in a building or other structure. The device may be provided as a product that includes a pre-fabricated rough framing kit for a door, for a window, or for a passageway. The framing kit product provides improved components used in forming a structural opening in a wall. In a particular embodiment, the framing kit includes improved components for the three primary components used in constructing a structural opening, namely an improved king stud, an improved jack stud and an improved header. The framing kit simplifies the construction of a structural opening, particularly for a do-it-yourself builder or for those less experienced at building. Trial and error cutting of materials is avoided, which can result in lower costs. The assembled components provide better structural integrity, material conservation, efficiency, and energy conservation when constructing a building opening.

Like conventional framing, the present product, device, system and method relies on three main components. The components are modified as compared to conventional components. By providing modified or engineered components, including modifications to the configuration and/or materials used, the structural integrity of the building components may be controlled. According to the present device and method, pre-cut pieces are provided for the components, which allow for quick and easy assembly of the components in a wall of a building or other structure. The pre-cut components in the kit provide elements and structures that are familiar to a professional home builder, carpenter, or other construction worker and provide simplicity for a novice seeking to assemble building elements. Embodiments of the present device and method are provided to accommodate all (or most) standard door widths and heights. An important feature is that embodiments of the product can be utilized in new construction, and can also be used in remodeling as well.

In certain embodiments, the product includes a kit that contains pre-fabricated headers, king studs and jack studs, which are pre-cut and measured to fit designated openings, such as doors, windows, or passageways. The king stud of a preferred embodiment of the kit is configured in the shape of the letter C, although other shapes are possible. The C-shape of the king stud has an inside surface contains two approximately 90 degree corners, although the invention is not limited to that shape. The C-shape provides an increase in the surface area of the king stud. A jack stud is provided to take advantage of the increased surface area of the king stud when placed into contact with the king stud. In particular, the jack stud and header is received in the king stud in an interlocking fashion. The king stud of certain embodiments are pre-cut to fit standard ceiling heights and account for standard wall thicknesses (for example, walls formed using 2×3, 2×4, or 2×6 construction elements) or any other potential wall thickness. The king stud may be provided in different thicknesses or may be larger or smaller in other dimensions based upon the structural requirements that are to be met.

Another aspect of certain embodiments is to include in the kit metal brackets that are to be used to attach the king stud to both the top plate and sole plate. Fasteners or brackets could be added to other parts of the system as well. The brackets are not required in every embodiment but may increase the stability of the structure when used.

The jack stud according to preferred embodiments is configured with a shaped portion that fits into the king stud. The jack stud preferably interlocks with the king stud while also supporting the header that is disposed above the jack stud, and bearing down onto the sole plate that is below the jack stud. Like the king stud, the jack stud of certain embodiments is pre-cut to accommodate standard door heights and widths. Examples of jack studs are provided for door heights of 6 feet, 8 inches; 7 feet; and/or 8 feet. Like the king stud, the jack stud may be of engineered configuration and materials. The jack stud can be provided with either smaller or larger dimensions based on load requirements of the wall opening. The jack stud of certain embodiments may be provided separately or may be provided as part of the kit, or the jack stud and king stud can be joined to one another (pre-assembled) before the product is provided to the customer/builder, further simplifying the assembly process for the builder. In an alternate embodiment, the jack stud and king stud may be provided as a formed single piece element.

The header of certain embodiments is configured as a pre-cut component that is sized to fit the span of standard wall openings. The header of preferred embodiments is pre-cut not only to fit the span and height of the opening, but also to fit into the king stud in an interlocking fashion. The header may be provided as a pre-assembled unit with the king studs and jack studs, or as separate pieces. The header and the jack stud both interlock with the king stud. The shape, dimensions, and materials used in the header may be selected and engineered based upon load requirements, R-value needs, etc. The present header according to certain embodiments is of a size, material and configuration that are selected based on the kit in which it is to be included. For example, heavy load bearing components are provided together in a kit for heavy load installations, whereas a lighter load kit will be provided with components for bearing lighter loads. The header provided in the kit may be selected from insulated headers, solid headers, reinforced headers, and the like. Each component of the rough wall opening is pre-fabricated, especially the header, so that it is assured that measurements will be accurate and that each element of the design will be an optimal fit in relation to each other.

According to the present device and method, the header still bears on the two jack studs, however the greater contact surface area between the jack stud and the king stud changes the way that the weight of the header is transferred between the jack stud and the king stud. Multiple points of contact between the king stud and the jack stud ensure a snug and more stable fit as well as sharing of the load by the header.

In a usual construction, the component pieces of a rough frame of a wall opening are nailed together, which can be used here. The configuration of the components permits the use of glue, nails, screws, and/or brackets if desired. With more contacting surface area between the components, the present device provides an upgrade to conventional methods.

The present device, method, kit and system of certain embodiments eliminates the need for the builder, who may be a do-it-your-self builder, for example, to know how to frame a standard door opening or passageway. The present device and method not only makes it easier to construct the opening properly, but it potentially adds strength to the structure as a whole. The components provided in the present device, method and kit may be formed of recycled lumber, laminated wood, compressed lumber, plastics, and metals. The materials, construction, and configuration of the components are not limited to particular materials, constructions or configurations.

The present device, method, system and kit provides to the market a product that provides the materials for assembly of a structural opening, be it a door, passageway, or window. The preferred device, method, system and kit provide pre-cut jack studs. The present kit may be provided as either a knockdown kit or as a pre-assembled unit.

A significant feature of the present device is the utilization of the three different interconnecting elements, and that the components are pre-cut and included in one, easy to assemble kit. The king stud, jack stud, and header each have a distinctive shape that allows them to function properly when used with the correlating pieces that are included in the kit. The distinctive shape of each component provides interlocking of the pieces. In certain embodiments, the kits are of pre-cut, conventional lumber.

In certain embodiments, brackets are included with the kit. The brackets need not be provided for all embodiments of the kit. The brackets can be supplements or optional components that may enhance the structural stability of the structure and the ease of installation of the components. For instance, the brackets could be used in buildings located in hurricane zones. One such bracket could be placed to connect the king and jack studs to the sole plate as already described. Another bracket could connect the king stud to the top plate. A further bracket could connect the header to the king and/or jack studs. In certain embodiments, six brackets are used (three on each side of the wall opening). The brackets are not required in every construction but may be used as desired, for example to enhance stability of the construction, ease of assembly, or for other reasons.

The present apparatus and method in certain embodiments provides solutions to problems that may occur in the field. A kit may be provided according to some embodiments to enable people with a limited construction background to properly construct an opening in the wall of a building. In some embodiments, a person desiring to build or remodel a home or other building is able enter a store, purchase the kit or the components as a product, and install it themselves, free of hassle. In addition to benefits for a do-it-yourself builder, significant advantages are provided by a kit embodiment for people in the professional building field. Because the parts of the kit are pre-fabricated, no cuts need to be made for the frame construction, so that the professional builder will save valuable time on the job site. Secondly, generating an estimate of costs is simpler; each door framing kit will have a predetermined price. Instead of calculating the costs for the loose lumber that is used for the door frame, for example, the builder may simply count the number of framing kits that are needed. This makes estimating jobs far simpler as the cost for the doorways, passageways and window openings becomes standardized. Embodiments that provide the parts in a kit will simplify the building process, saving time, money, and material.

Thus, there are shown and described framing components for doorway, window, and passageway framing in a building. The framing components include king studs, jack studs and a header. The components may be provided separately or may be provided in a kit that is cut to the correct length and sized for the particular construction project.

Although other modifications and changes may be suggested by those skilled in the art, it is the intention of the inventors to embody within the patent warranted hereon all changes and modifications as reasonably and properly come within the scope of their contribution to the art.

I claim:

1. A kit for framing a door, window, or passageway in a wall, comprising:

first and second king studs each having a first length, the first and second king studs each defining a channel extending in a direction of the first length of the king studs, the channel being formed in a side of each of the first and second king studs;

first and second jack studs each of a second length, the first and second jack studs each having a raised strip extending in a direction of the second length of the jack studs, the raised strip being formed along a side of each of the jack studs, the raised strip of the first jack stud being configured to fit into the channel of the first king stud and the raised strip of the second jack stud being configured to fit into the channel of the second king stud;

a header having an elongated body with first and second ends, the first and second ends each having an end projection, the end projection of the first end being configured to fit into the channel of the first king stud and the end projection of the second end being configured to fit into the channel of the second king stud; and the first and second king studs and the first and second jack studs and the header being fastenable to one another to form a frame for a doorway, window or passageway.

2. A kit as claimed in claim 1, wherein the channels in the king studs and the raised strips of the jack studs are of approximately a same width.

3. A kit as claimed in claim 1, wherein the first king stud and the first jack stud fit together to form a beam.

4. A kit as claimed in claim 3, wherein the beam defines an interior space between the channel of the first king stud and the raised strip of the first jack stud.

5. A kit as claimed in claim 1, wherein the header includes first and second end blocks extending from corresponding ones of the first and second ends of the header, the header including header planks connecting the first and second end blocks to one another.

6. A kit as claimed in claim 1, wherein the first king stud has a width in a direction perpendicular to a depth of the channel, wherein the first jack stud has a width in a direction perpendicular to a height of the raised strip, the width of the first king stud being substantially the same as the width of the first jack stud.

7. A kit as claimed in claim 6, wherein the header has a width in a direction perpendicular to a length of the header, the width of the header being substantially the same as the width of the first king stud and the width of the first jack stud.

8. A kit as claimed in claim 1, wherein the first and second king studs and the first and second jack studs and the header are connected in interlocking relation.

9. A kit as claimed in claim 1, further comprising:

brackets for fastening the first and second king studs to a bottom plate of a wall frame.

10. A kit as claimed in claim 1, further comprising:

brackets for fastening the first and second king studs to the header.

11. A frame, comprising:

first and second beams on opposite sides of a door frame, each of the first and second beams including a king stud and a jack stud, each of the king studs including a first elongated member formed with a channel extending substantially along a length of the first elongated member, each of the jack studs including a second elongated member formed with a raised strip extending substantially along a length of the second elongated member, the jack studs being affixed to respective ones of the king studs with the raised strips of the jack studs extending into the respective channels of the king studs; and a header having first and second ends, each of the first and second ends being formed with an end projection, the first and second end projections extending into corresponding channels of the first and second king studs, the first and second end projections of the header bearing on respective ones of the first and second jack studs.

12. A frame as claimed in claim 11, wherein the frame is a doorway frame.

13. A method for framing a doorway, window or passageway, comprising:

inserting a first raised strip of a first jack stud into a first channel of a first king stud to form a first beam;

inserting a second raised strip of a second jack stud into a second channel of a second king stud to form a second beam;

inserting a first end of a header into the first channel of the first king stud;

inserting a second end of the header into the second channel of the second king stud;

positioning the header in the first channel of the first king stud so that the first end of the header bears against an end of the first jack stud; and positioning the header in the second channel of the second king stud so that the second end of the header bears against an end of the second jack stud, so as to form a frame for a doorway, window or passageway.

14. A method for making a kit for framing a doorway, window or passageway, comprising:

forming first and second king studs, the first and second king studs being of a first length, the forming of the first and second king studs including forming an elongated channel extending substantially along the first length of each of the first and second king studs;

forming first and second jack studs, the first and second jack studs being of a second length less than the first length, the forming of the first and second jack studs including forming a raised strip extending along the second length of each of the first and second jack studs, the raised strips of the jack studs being configured to fit into the channels of the king studs; and forming a header, the forming the header including forming first and second end projections at opposite ends of the header, the first and second end projections being configured to fit into the channels of the king studs.

15. A method as claimed in claim 14, wherein the forming of the header includes affixing header planks on opposite sides of first and second end blocks.

* * * * *